US009355809B2

(12) United States Patent
Kakutani et al.

(10) Patent No.: US 9,355,809 B2
(45) Date of Patent: May 31, 2016

(54) ION SOURCE

(71) Applicant: KABUSHIKI KAISHA TOSHIBA, Tokyo (JP)

(72) Inventors: Akiko Kakutani, Yokohama (JP); Kiyoshi Hashimoto, Yokohama (JP); Kiyokazu Sato, Tokyo (JP); Akihiro Osanai, Yokohama (JP); Takeshi Yoshiyuki, Yokohama (JP); Tsutomu Kurusu, Tokyo (JP); Kazuo Hayashi, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 13/777,071

(22) Filed: Feb. 26, 2013

(65) Prior Publication Data

US 2013/0228698 A1 Sep. 5, 2013

(30) Foreign Application Priority Data

Mar. 5, 2012 (JP) ..... 2012-047952

(51) Int. Cl.
*H01J 27/24* (2006.01)

(52) U.S. Cl.
CPC ..... *H01J 27/24* (2013.01)

(58) Field of Classification Search
CPC ..... H01J 27/00; H01J 27/02; H01J 27/022; H01J 27/024; H01J 27/24; H01J 49/162; H01J 49/164; H01J 2237/08; H01J 2237/081
USPC ..... 250/288, 289, 423 R, 424, 425, 423 P
See application file for complete search history.

(56) References Cited

U.S. PATENT DOCUMENTS 4,426,576 A * 1/1984 Hurst et al. ..... 250/283
6,103,069 A * 8/2000 Davenport ..... 204/192.12
6,169,288 B1 * 1/2001 Horino ..... H01J 37/08 250/423 P
2002/0166960 A1 * 11/2002 Pronko ..... B01D 59/44 250/282

(Continued)

FOREIGN PATENT DOCUMENTS

JP 63-204726 8/1988
JP 4-292841 10/1992

(Continued)

OTHER PUBLICATIONS

Japanese Office Action issued May 7, 2014, in Japan Patent Application No. 2012-047952 (with English translation).

(Continued)

*Primary Examiner* — Jack Berman
*Assistant Examiner* — David E Smith
(74) *Attorney, Agent, or Firm* — Oblon, McClelland, Maier & Neustadt, L.L.P

(57) ABSTRACT

According to one embodiments, an ion source connected with a vacuum-exhausted downstream apparatus is provided. The ion source includes a vacuum chamber which is vacuum-exhausted, a target which is set in the vacuum chamber and generates ions by irradiation of a laser beam, a transportation unit which transports the ions generated by the target to the downstream apparatus, and a vacuum sealing unit which seals the transportation unit so as to separate vacuum-conditions of the vacuum chamber side and the downstream apparatus side before exchanging the target set in the vacuum chamber.

7 Claims, 8 Drawing Sheets

(56) References Cited

U.S. PATENT DOCUMENTS

| | | | | |
|---|---|---|---|---|
| 2004/0079915 | A1* | 4/2004 | Contin et al. | 251/167 |
| 2004/0238753 | A1* | 12/2004 | Mikolas | H01J 37/08 250/396 R |
| 2008/0272286 | A1* | 11/2008 | Vestal | B08B 1/00 250/282 |
| 2008/0290297 | A1* | 11/2008 | Blasche | A61N 5/1078 250/492.3 |
| 2013/0001440 | A1* | 1/2013 | Koo et al. | 250/492.3 |

FOREIGN PATENT DOCUMENTS

| | | |
|---|---|---|
| JP | 5-23409 U | 3/1993 |
| JP | 5-62606 | 3/1993 |
| JP | 7-161336 | 6/1995 |
| JP | 10-140340 | 5/1998 |
| JP | 2003-59699 | 2/2003 |
| JP | 3713524 | 9/2005 |
| JP | 2006-59774 | 3/2006 |
| JP | 2007-305560 | 11/2007 |
| JP | 2008-504669 | 2/2008 |
| JP | 2008-293773 | 12/2008 |
| JP | 2009-37764 | 2/2009 |

OTHER PUBLICATIONS

Hirotsugu Kashiwagi, et al., "Acceleration of High Current and Highly Charged Carbon Beam using direct Injection Scheme", Proceedings of the 2nd Annual Meeting of Particle Accelerator Society of Japan and the 30th Linear Accelerator Meeting in Japan , 2005, 3 pages (with partial English translation).

Office Action mailed Dec. 16, 2014 in Japanese Application No. 2012-047952 filed Mar. 5, 2012 (w/English translation).

Office Action mailed Mar. 31, 2015 in Japanese Application No. 2014-139645 (w/English translation).

Combined Office Action and Search Report issued Nov. 4, 2015 in Chinese Patent Application No. 201310068783.2 (with English translation).

Office Action issued Sep. 15, 2015 in Japanese Patent Application No. 2014-139645 (with English translation).

* cited by examiner

ION SOURCE

CROSS-REFERENCE TO RELATED APPLICATIONS

This application is based upon and claims the benefit of priority from Japanese Patent Application No. 2012-047952, filed Mar. 5, 2012, the entire contents of which are incorporated herein by reference.

FIELD

Embodiments described herein relate generally to an ion source that generates ions by irradiation of a laser beam.

BACKGROUND

In general, as a method of generating ions in an ion source, for example, a method of generating the ions by causing discharge in gas has been known. In this case, a microwave or an electron beam may be used in order to cause the discharge.

Meanwhile, a technology that generates ions by using a laser is present. By an ion source (hereinafter, referred to as a laser ion source) that generates the ions by using the laser, a laser beam is focused and irradiated onto a target set in a vacuum chamber, an element contained the target is vaporized (ablated) and ionized by energy of the laser beam to generate plasmas, the ions contained in the plasmas are transported as the plasmas are, and the ions are accelerated while extracting an ion beam.

According to the laser ion source, the ions can be generated by irradiating the laser to the solid target and it is advantageous in generation of multi-charged ions.

The ions generated in the laser ion source have a vertical initial velocity to the solid target (a surface of the solid target to which the laser beam is irradiated). As a result, a transportation pipe having the same potential as a generation section of the ions is extended to a downstream part to transport the ions. Further, the ions generated in the laser ion source are transported to a downstream apparatus (for example, a linear accelerator, and the like) connected to the laser ion source.

However, in order to stabilize an ion generation condition in the laser ion source, states (surface roughness, a distance from a focusing lens, and the like) at a point (hereinafter, referred to as an irradiation point) on the target to which the laser beam is irradiated need to be the same at all times. However, a crater is generated on the target onto which the laser beam is focused and irradiated, by ablation which occurs by focusing and irradiating the laser beam. That is, since the states of the irradiation point are different from each other in the case where the laser beam is further irradiated to the point to which the laser beam is already irradiated, it is difficult to stably generate the ions.

As a result, in the laser ion source, when the laser beam is irradiated to the target, the target needs to move in order to avoid the point on the target to which the laser beam is already irradiated. In the case where the laser beam is irradiated onto all surfaces of the target (that is, in the case where all the surfaces of the target are used), the target set in the vacuum chamber needs to be exchanged.

In the aforementioned laser ion source, vacuum needs to be released in order to exchange the target set in the vacuum chamber. In this case, a vacuum condition of the downstream apparatus connected to the laser ion source is also damaged and a lot of time is required to make a high vacuum state again. As a result, a maintenance time in the laser ion source is lengthened, which is not practical.

DETAILED DESCRIPTION

Hereinafter, embodiments of the invention will be described with reference to the accompanying drawings. According to one embodiments, in general, an ion source connected with a vacuum-exhausted downstream apparatus is provided. The ion source includes a vacuum chamber which is vacuum-exhausted; a target which is set in the vacuum chamber and generates ions by irradiation of a laser beam; a transportation unit which transports the ions generated by the target to the downstream apparatus; and a vacuum sealing unit which seals the transportation unit so as to separate vacuum-conditions of the vacuum chamber side and the downstream apparatus side before exchanging the target set in the vacuum chamber.

First Embodiment

Figure 1:
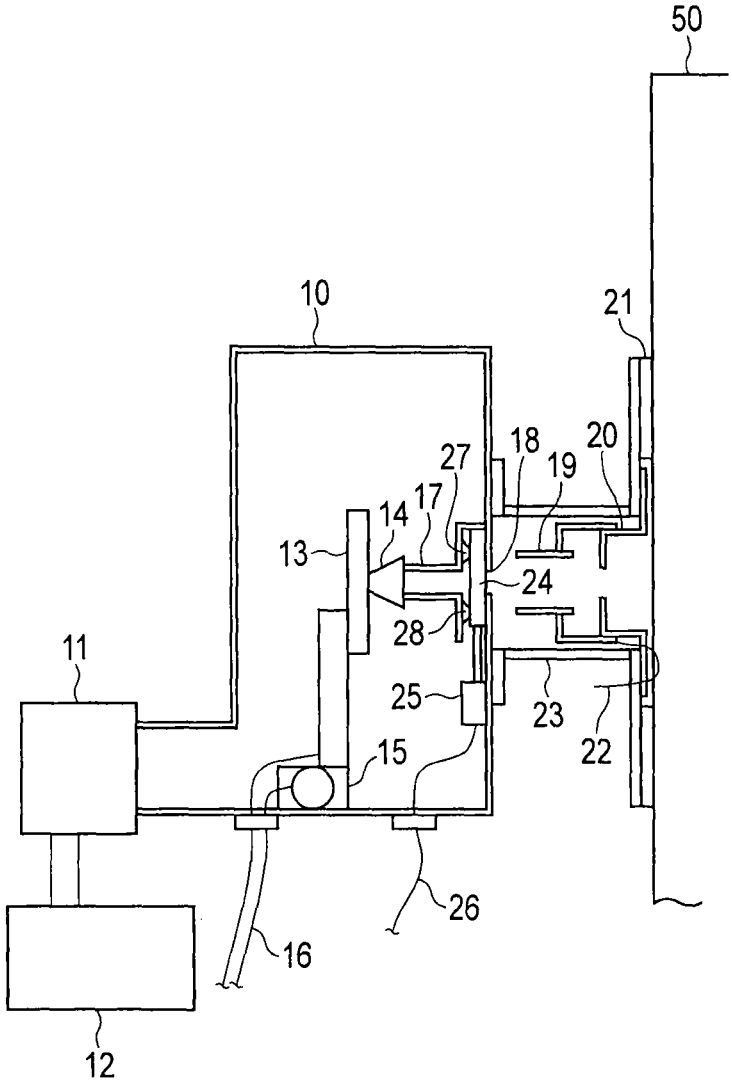
FIG. 1 is a cross-sectional view illustrating a configuration of an ion source according to a first embodiment of the invention.

First, a first embodiment of the invention will be described with reference to FIG. 1. FIG. 1 illustrates a configuration of an ion source according to the embodiment. The ion source is, for example, a device that vaporizes (ablates) and ionizes a target element by using a laser beam to generate plasmas, transports ions contained in the plasmas as the plasmas are, and accelerates the ions while extracting to make an ion beam.

As illustrated in FIG. 1, the ion source according to the embodiment includes a vacuum chamber 10. The vacuum chamber 10 is connected with, for example, a vacuum pump for vacuum-exhausting the vacuum chamber 10. As the vacuum pump for vacuum-exhausting the vacuum chamber 10, for example, a turbo molecular pump 11 and a rotary pump (auxiliary pump) 12 are used.

A target 13 that generates ions by irradiation of the laser beam is set in the vacuum chamber 10. The laser beam, which is focused by using a focusing lens (not illustrated), is irradiated to the target 13 to generate plasmas 14. The plasmas 14 contain multi-charged ions of a target material as a target in the ion source. Further, a high-frequency wave, arc discharge, or an electron beam may be used to generate the plasmas 14.

Further, since the laser beam is irradiated onto a new surface (irradiation point) of the target 13 at all times, the target 13 is biaxially driven by using a stepping motor 15 connected to the target 13. In addition, the stepping motor 15 may be controlled via a cable 16 drawn outside vacuum by using, for example, an introduction terminal attaching flange, and the like.

The ions contained in the plasmas 14 generated by irradiating the laser beam to the target 13 are transported to a downstream apparatus of the ion source, for example, a linear accelerator (hereinafter, referred to as RFQ) 50 via a transportation pipe 17, an aperture 18, an intermediate electrode 19, and an acceleration electrode 20. That is, the transportation pipe 17, the aperture 18, the intermediate electrode 19, and the acceleration electrode 20 constitute a transportation unit that transports the ions (the ions contained in the plasmas 14) generated from the target 13 to the downstream apparatus of the ion source.

Further, the transportation pipe 17, the aperture 18, the intermediate electrode 19, and the acceleration electrode 20 control extracting of the ion beam emitted from the ion source.

As illustrated in FIG. 1, the transportation pipe 17 is installed at a position to transport the ions contained in the plasmas 14 generated by irradiating the laser beam to the target 13 in the vacuum chamber 10 and the aperture 18 is provided at, for example, the vacuum chamber 10 side.

The intermediate electrode 19 is applied with, for example, voltage to extract multi-charged ions of a target material as a target in the ion source from the plasmas 14 transported via the transportation pipe 17 and the aperture 18. The intermediate electrode 19 is installed in for example, the acceleration electrode 20 or a flange 21 through an insulation. A wiring 22 for applying voltage to the intermediate electrode 19 is connected through, for example, the flange 21. Further, the vacuum chamber 10 and the flange 21 are connected to each other through an insulation such as, for example, a ceramic duct 23, and the like so as to apply acceleration voltage (voltage applied to the acceleration electrode 20).

The acceleration electrode 20 is applied with voltage in order to accelerate the ions that pass through the intermediate electrode 19. The acceleration electrode 20 is held on the flange 21 coupled with the RFQ 50.

Further, the ion source according to the embodiment includes a vacuum sealing disk (vacuum sealing plate) 24. The vacuum sealing disk 24 is connected with an actuator 25. The actuator 25 linearly drives the vacuum sealing disk 24 between an end portion of the transportation pipe 17 at the RFQ 50 side and the aperture 18, for example, as illustrated in FIG. 1. As a result, the vacuum sealing disk 24 seals the aperture (that is, a transportation unit) 18 so as to separate vacuum-conditions (vacuum states) of the vacuum chamber 10 side and the RFQ 50 side with the aperture 18 (a side wall of the vacuum chamber 10 of the RFQ 50 side), for example, as a boundary. In other words, the vacuum sealing disk 24 seals vacuum at the RFQ 50 side from the aperture 18. In addition, the actuator 25 is controllable through a cable 26 drawn outside vacuum by using the introduction terminal attached flange, and the like.

The vacuum sealing disk 24 is fixed by a guide 27 and a compressing elastic body (for example, a spring, and the like) 28.

Herein, as described above, in the ion source, since the laser beam is irradiated to a new surface of the target 13 at all times, for example, in the case where the laser beam is irradiated to all surfaces of the target 13, the target 13 set in the vacuum chamber 10 needs to be exchanged with anew target 13.

Hereinafter, an operation when the target 13 is exchanged in the ion source according to the embodiment will be described.

In the embodiment, the vacuum sealing disk 24 is driven by using the actuator 25 as described above, and as a result, a state in which vacuum-conditions of the vacuum chamber 10 side and the RFQ 50 side are separated from each other (that is, a state in which vacuum of the RFQ 50 side is sealed) and a state in which vacuum-conditions of the vacuum chamber 10 side and the RFQ 50 side are not separated from each other (that is, a state in which the vacuum of the RFQ 50 side is not sealed) may be switched. In detail, in the case where the vacuum sealing disk 24 is installed at a position to close a flow channel between the vacuum chamber 10 and the RFQ 50 (that is, a position to stop up the aperture 18) by using the actuator 25, the vacuum-conditions of the vacuum chamber 10 side and the RFQ side may be separated from each other. Meanwhile, in the case where the vacuum sealing disk 24 is installed at a position to open the flow channel between the vacuum chamber 10 and the RFQ 50 (that is, a position to open up the aperture 18) by using the actuator 25, the vacuum-conditions of the vacuum chamber 10 side and the RFQ 50 side may not be separated from each other.

Hereinafter, the state in which the vacuum sealing disk 24 is installed at the position to close the flow channel between the vacuum chamber 10 and the RFQ 50 is called a sealing state and the state in which the vacuum sealing disk 24 is installed at the position to open the flow channel between the vacuum chamber 10 and the RFQ 50 is called an opening state.

In the case where ions generated by focusing and irradiating the laser beam to the target 13 in the ion source are transported to the RFQ 50 as described above, the vacuum sealing disk 24 is in the opening state by driving the vacuum sealing disk 24 using the actuator 25.

Meanwhile, in the case where the laser beam is irradiated onto all the surfaces of the target 13 and the target 13 needs to be exchanged, the vacuum sealing disk 24 is in the sealing state by driving the vacuum sealing disk 24 using the actuator 25 as described above, before exchanging the target 13 (the opening state is switched to the sealing state).

When the vacuum sealing disk 24 is in the sealing state as described above, the vacuum chamber 10 is released to the atmosphere and the target (the target of which all the surfaces are irradiated with the laser beam) 13 which is set in the vacuum chamber 10 is exchanged to the new target 13. In this case, since the vacuum sealing disk 24 is in the sealing state as described above, the vacuum of the RFQ 50 side is maintained.

When the new target 13 is set in the vacuum chamber 10, the vacuum chamber 10 is vacuum-exhausted by a vacuum pump (the turbo molecular pump 11 and the rotary pump 12) connected to the vacuum chamber 10.

When the vacuum chamber 10 where the new target 13 is set is vacuum-exhausted, the vacuum sealing disk 24 is in the opening state by driving the vacuum sealing disk 24 using the actuator 25 (the sealing state is switched to the opening state).

After the vacuum sealing disk 24 is in the opening state, the laser beam is focused and irradiated onto the new target 13 set in the vacuum chamber 10 to generate ions and the ions may be transported to the RFQ 50.

In the embodiment as described above, by a configuration including the vacuum chamber 10 which is vacuum-exhausted, the target 13 which is set in the vacuum chamber 10 and generates ions by irradiating the laser beam, the transportation unit (for example, the transportation pipe 17, the aperture 18, the intermediate electrode 19, and the acceleration electrode 20) which transports the ions generated from the target 13 to a downstream apparatus such as the RFQ 50, and the like, and the vacuum sealing disk 24 which seals the transportation unit (for example, the aperture 18) so as to separate the vacuum-conditions of the vacuum chamber 10 side and the RFQ 50 side at the time of exchanging the target 13 set in the vacuum chamber 10, the vacuum of the RFQ 50 side may be sealed only as necessary without influencing extracting of the ion beam in the ion source to thereby exchange the target 13 without releasing the vacuum of the downstream apparatus.

Further, in the embodiment, the aperture 18 is set in the downstream side (RFQ 50 side) of the vacuum sealing disk 24, but the aperture 18 may also serve as the end portion of the transportation pipe 17 or the guide 27.

Second Embodiment

Figure 2:
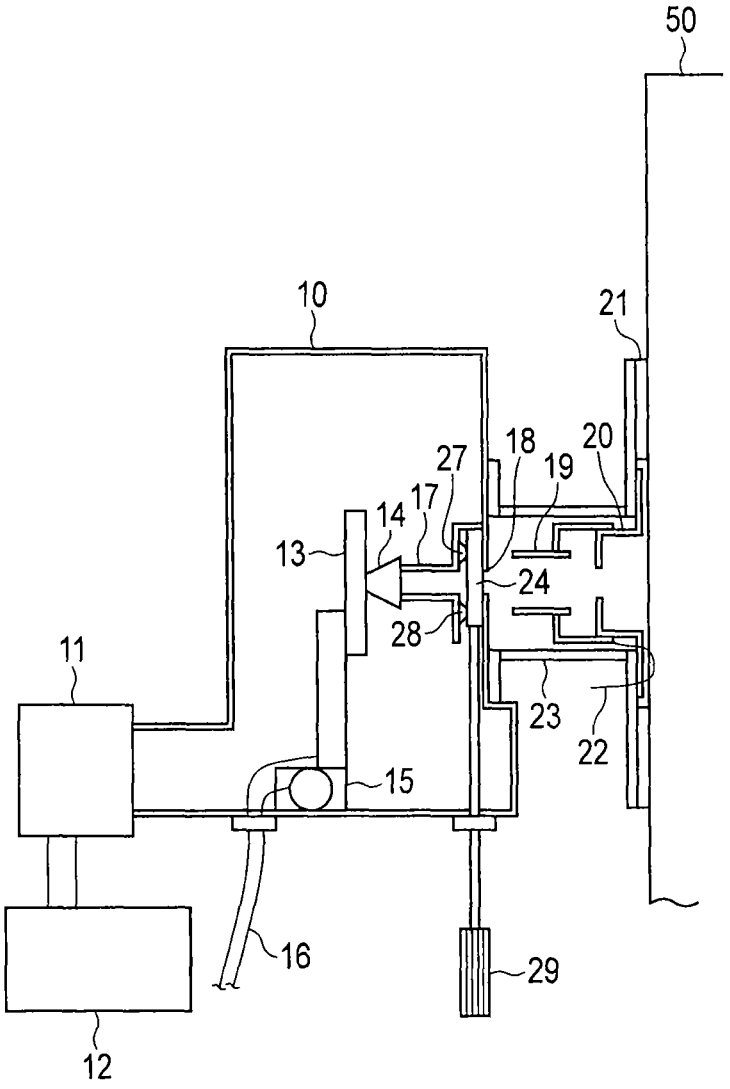
FIG. 2 is a cross-sectional view illustrating a configuration of an ion source according to a second embodiment of the invention.

Subsequently, a second embodiment of the invention will be described with reference to FIG. 2. FIG. 2 illustrates a configuration of an ion source according to the embodiment. Further, the reference numerals refer to the same elements as in FIG. 1 and a detailed description thereof will be omitted. Herein, elements different from those of FIG. 1 will be primarily described.

In the embodiment, as illustrated in FIG. 2, a vacuum sealing disk 24 is connected to a linear introducer 29 provided outside a vacuum chamber 10.

The linear introducer 29 linearly drives the vacuum sealing disk 24 between an end portion of a transportation pipe 17 at the RFQ 50 side and an aperture 18. As a result, the vacuum sealing disk 24 seals the aperture 18 (that is, the transportation unit) so as to separate vacuum-conditions of the vacuum chamber 10 side and the RFQ 50 side with the aperture 18 (the side wall of the vacuum chamber 10 of the RFQ 50 side), for example, as the boundary.

Further, the vacuum sealing disk 24 is fixed by a guide 27 and a compressing elastic body 28, similarly as the first embodiment.

In the embodiment as describe above, the vacuum sealing disk 24 is driven by the linear introducer 29, thereby switching a state (a sealing state) in which vacuum-conditions of the vacuum chamber 10 side and the RFQ 50 side are separated from each other and a state (an opening state) in which the vacuum-conditions of the vacuum chamber 10 side and the RFQ 50 side are not separated from each other.

Further, an operation when exchanging the target 13 in the ion source according to the embodiment is the same as that of the first embodiment, except that the sealing state and the opening state are switched by driving the vacuum sealing disk 24 using the linear introducer 29, and a detailed description thereof will be omitted.

In the embodiment as described above, by a configuration of sealing the transportation unit (for example, the aperture 18) so as to separate the vacuum-conditions of the vacuum chamber 10 side and the RFQ 50 side by the vacuum sealing disk 24 connected to the linear introducer 29, the vacuum of the RFQ 50 side may be sealed only as necessary without influencing extracting of an ion beam in the ion source to thereby exchange the target 13 without releasing the vacuum of a downstream apparatus.

Third Embodiment

Figure 3:
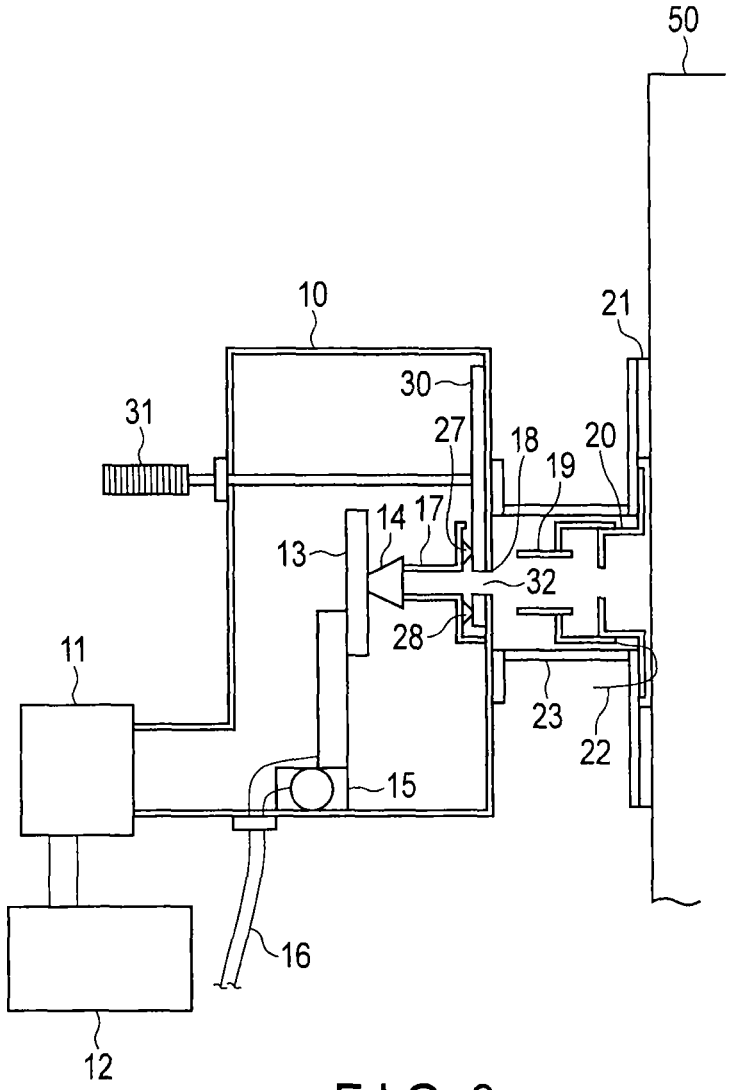
FIG. 3 is a cross-sectional view illustrating a configuration of an ion source according to a third embodiment of the invention.

Subsequently, a third embodiment of the invention will be described with reference to FIG. 3. FIG. 3 illustrates a configuration of an ion source according to the embodiment. Further, the reference numerals refer to the same elements as in FIG. 1 and a detailed description thereof will be omitted. Herein, elements different from those of FIG. 1 will be primarily described.

In the embodiment, as illustrated in FIG. 3, a vacuum sealing disk 30 is connected to a rotary introducer 31 provided outside a vacuum chamber 10.

The rotary introducer 31 rotates the vacuum sealing disk 30 between an end portion of an RFQ 50 side of a transportation pipe 17 and an aperture 18. Further, a hole portion 32 through which ions may pass is formed in the vacuum sealing disk 30 in order to transport the ions.

In the embodiment, when the vacuum-conditions of the vacuum chamber 10 side and the RFQ 50 side are separated, the vacuum sealing disk 30 is rotated by using the rotary introducer 31, and as a result, a surface other than the hole portion 32 is set between the end portion of the RFQ 50 side of the transportation pipe 17 and the aperture 18. Meanwhile, in the case where the vacuum-conditions of the vacuum chamber 10 side and the RFQ 50 side are not separated, the vacuum sealing disk 30 is rotated by using the rotary introducer 31, and as a result, the hole portion 32 provided in the vacuum sealing disk 30 is set at a position to transport the ions between the transportation pipe 17 and the aperture 18. Further, the vacuum sealing disk 30 is fixed by a guide 27 and a compressing elastic body 28, similarly as the first embodiment.

As a result, in the embodiment, the vacuum sealing disk 30 is rotated by the rotary introducer 31, thereby switching a state (a sealing state) in which the vacuum-conditions of the vacuum chamber 10 side and the RFQ 50 side are separated from each other and a state (an opening state) in which the vacuum-conditions of the vacuum chamber 10 side and the RFQ 50 side are not separated from each other.

Further, an operation when exchanging a target 13 in the ion source according to the embodiment is the same as that of the first embodiment, except that the sealing state and the opening state are switched by driving the vacuum sealing disk 30 using the rotary introducer 31, and a detailed description thereof will be omitted.

In the embodiment as described above, by a configuration of sealing the transportation unit (for example, the aperture 18) so as to separate the vacuum-conditions of the vacuum chamber 10 side and the RFQ 50 side by the vacuum sealing disk 30 connected to the rotary introducer 31, the vacuum of the RFQ 50 side may be sealed only as necessary without influencing extracting of an ion beam in the ion source to thereby exchange the target 13 without releasing the vacuum of a downstream apparatus.

Fourth Embodiment

Figure 4:
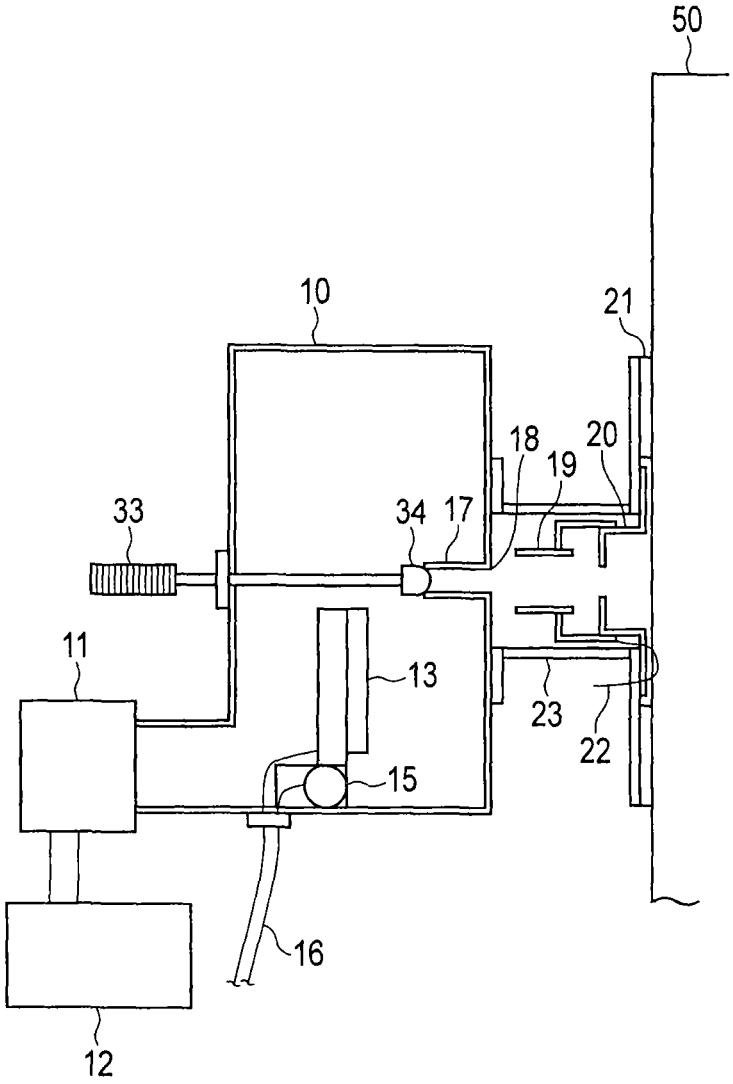
FIG. 4 is a cross-sectional view illustrating a configuration of an ion source according to a fourth embodiment of the invention.

Subsequently, a fourth embodiment of the invention will be described with reference to FIG. 4. FIG. 4 illustrates a configuration of an ion source according to the embodiment. Further, the reference numerals refer to the same elements as FIG. 1 and a detailed description thereof will be omitted. Herein, elements different from those of FIG. 1 will be primarily described. In addition, in FIG. 4, an aperture 18 also serves as an end portion of a transportation pipe 17.

In the embodiment, a cap 34 is attached to a front end of a rotary introducer 33 provided outside a vacuum chamber 10, as illustrated in FIG. 4.

The rotary introducer 33 has a function in which a shaft is stretched by rotation of the rotary introducer 33.

In the embodiment, when vacuum-conditions of the vacuum chamber 10 side and an RFQ 50 side are separated, the shaft is stretched by the rotation of the rotary introducer 33 and the cap 34 attached to the front end of the rotary introducer 33 is brought into close contact with an end portion of the vacuum chamber 10 side of a transportation pipe 17. Meanwhile, when the vacuum-conditions of the vacuum chamber 10 side and the RFQ 50 side are not separated, the shaft is contracted by the rotation of the rotary introducer 33 and the cap 34 attached to the front end of the rotary introducer 33 is separated from the end portion of the vacuum chamber 10 side of the transportation pipe 17.

As a result, in the embodiment, the end portion of the transportation pipe 17 at the vacuum chamber 10 side is sealed and opened with the cap 34 attached to the front end of the rotary introducer 33, thereby switching a state (a sealing state) in which the vacuum-conditions of the vacuum chamber 10 side and the RFQ 50 side are separated from each other and a state (an opening state) in which the vacuum-conditions of the vacuum chamber 10 side and the RFQ 50 side are not separated from each other.

Further, the cap 34 attached to the front end of the rotary introducer 33 is brought into close contact with the end portion of the transportation pipe 17 at the vacuum chamber 10 side and maintain the vacuum state. The cap 34 may be made of, for example, Teflon (registered trademark), Teflon with O-ring or metal with O-ring.

Subsequently, an operation when a target 13 is exchanged in the ion source according to the embodiment will be described.

In the case where ions generated by focusing and irradiating a laser beam onto the target 13 in the ion source according to the embodiment are transported to the RFQ 50, the shaft is contracted by the rotation of the rotary introducer 33 to achieve the opening state. In this case, the target 13 is set at a position where (ions contained in) plasmas generated by focusing and irradiating the laser beam onto the target 13 may be transported to a downstream part by the transportation pipe 17. Further, the shaft of the rotary introducer 33 (and the cap 34 attached to the front end of the rotary introducer 33) is contracted up to a position not to interfere with the target 13.

Meanwhile, in the case where the laser beam is irradiated onto all surfaces of the target 13 and the target 13 needs to be exchanged, the target 13 retreats to a position not to interfere with the shaft of the rotary introducer 33 (and the cap 34 attached to the front end of the rotary introducer 33) by using a stepping motor 15. After the target 13 retreats, the shaft is stretched by the rotation of the rotary introducer 33 and the sealing state is achieved by the cap 34 attached to the front end of the rotary introducer 33 (the opening state is switched to the sealing state).

When the sealing state is achieved by the cap 34 attached to the front end of the rotary introducer 33, the vacuum chamber 10 is released to the atmosphere and the target (the target of which all the surfaces are irradiated with the laser beam) 13 in the vacuum chamber 10 is exchanged with a new target 13.

When the new target 13 is set in the vacuum chamber 10, the vacuum chamber 10 is vacuum-exhausted by a vacuum pump (a turbo molecular pump 11 and a rotary pump 12) connected to the vacuum chamber 10.

When the vacuum chamber 10 with the new target 13 set therein is vacuum-exhausted, the shaft is contracted by the rotation of the rotary introducer 33, and as a result, the opening state is achieved (the sealing state is switched to the opening state).

After the opening state is achieved, the new target 13 is set at the position to transport the ions by the transportation pipe 17 by using the stepping motor 15, and as a result, ions are generated by focusing and irradiating the laser beam to the new target 13 and the ions may be transported to the RFQ 50.

In the embodiment as described above, by a configuration of sealing a transportation unit (the end portion of the transportation pipe 17 at the vacuum chamber 10 side so as to separate the vacuum-conditions of the vacuum chamber 10 side and the RFQ 50 side by the rotary introducer 33 which may stretch the shaft by the rotation thereof and the cap 34 attached to the front end of the rotary introducer 33, the vacuum of the RFQ 50 side may be sealed only as necessary without influencing extracting of the ion beam in the ion source to thereby exchange the target 13 without releasing the vacuum of the downstream apparatus.

Further, in the embodiment, the cap 34 is attached to the front end of the rotary introducer 33, but the vacuum of the RFQ 50 side may be sealed by directly inserting the shaft of the rotary introducer 33 into the transportation pipe 17 by using, for example, a Wilson seal.

Fifth Embodiment

Figure 5:
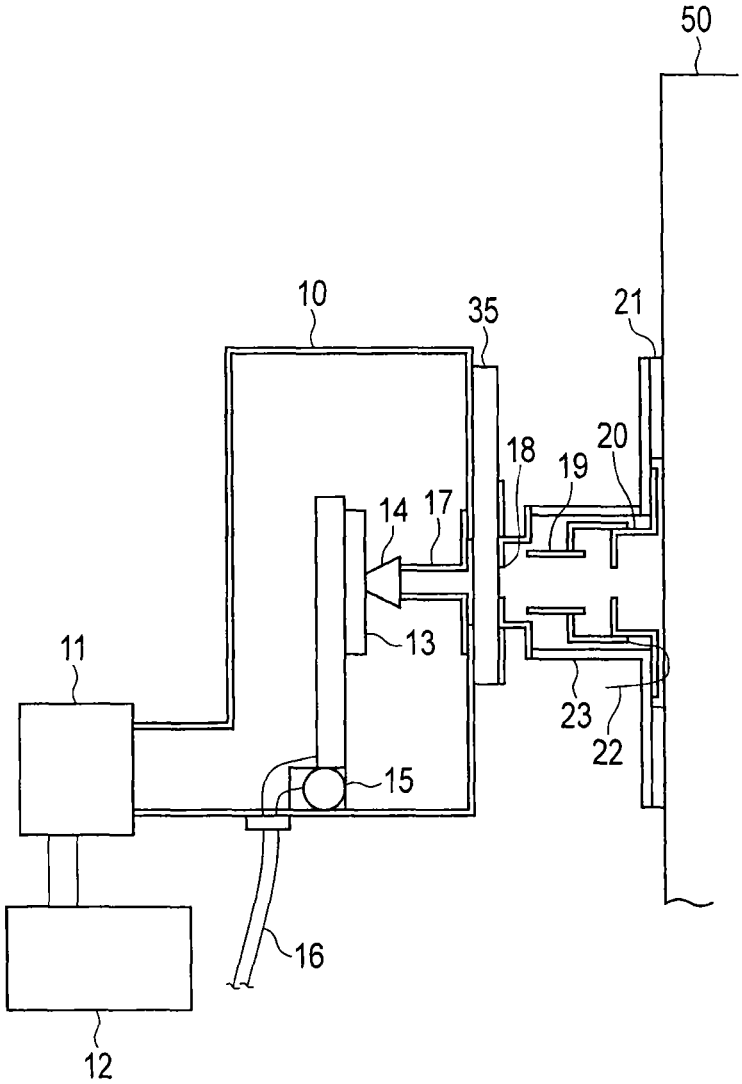
FIG. 5 is a cross-sectional view illustrating a configuration of an ion source according to a fifth embodiment of the invention.

Subsequently, a fifth embodiment of the invention will be described with reference to FIG. 5. FIG. 5 illustrates a configuration of an ion source according to the embodiment. Further, the reference numerals refer to the same elements as FIG. 1 and a detailed description thereof will be omitted. Herein, elements different from those of FIG. 1 will be primarily described.

In the embodiment, a gate valve 35 is provided between an end portion of an RFQ 50 side of a transportation pipe 17 and an aperture 18, as illustrated in FIG. 5. Further, in the embodiment, the aperture 18 is provided at a position to transport ions via the end portion of the RFQ 50 side of the transportation pipe 17 provided in a vacuum chamber 10 and the gate valve 35, as illustrated in FIG. 5.

The gate valve 35 serves to open/close a flow channel between the vacuum chamber 10 and a downstream apparatus of an ion source, for example, the RFQ 50.

In the embodiment, when vacuum-conditions of the vacuum chamber 10 side and the RFQ 50 side are separated, the gate valve 35 is closed. Meanwhile, when the vacuum-conditions of the vacuum chamber 10 side and the RFQ 50 side are not separated, the gate valve 35 is opened.

Further, in the ion source illustrated in FIG. 5, the aperture 18 is set in a downstream part of the gate valve 35, but the aperture 18 may also serve as an end portion of the RFQ 50 side of the transportation pipe 17. Even in the case where the aperture 18 serves as the end portion of the RFQ 50 side of the transportation pipe 17, the gate valve 35 may be appropriately installed at a position to separate the vacuum-conditions of the vacuum chamber 10 side and the RFQ 50 side.

As a result, in the embodiment, the gate valve 35 is opened/closed, thereby switching a state (a sealing state) in which the vacuum-conditions of the vacuum chamber 10 side and the RFQ 50 side are separated from each other and a state (an opening state) in which the vacuum-conditions of the vacuum chamber 10 side and the RFQ 50 side are not separated from each other.

Further, an operation when exchanging a target 13 in the ion source according to the embodiment is the same as that of the first embodiment, except that the sealing state and the opening state are switched by using the gate valve 35, and a detailed description thereof will be omitted.

In the embodiment as described above, by a configuration of sealing a transportation unit so as to separate the vacuum-conditions of the vacuum chamber 10 side and the RFQ 50 side by the gate valve 35 that opens/closes a flow channel of the transportation unit (for example, between the transportation pipe 17 and the aperture 18), the vacuum of the RFQ 50 side may be sealed only as necessary without influencing the extracting of the ion beam in the ion source to thereby exchange the target 13 without releasing the vacuum of the downstream apparatus.

Sixth Embodiment

Figure 6:
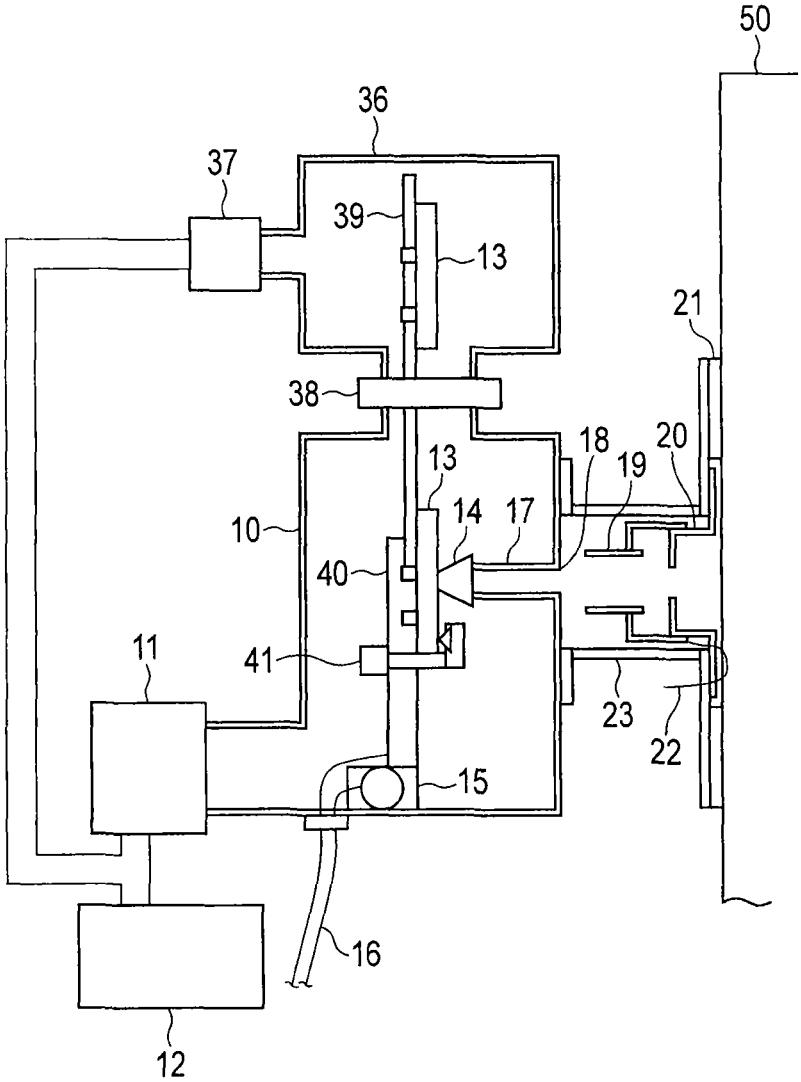
FIG. 6 is a cross-sectional view illustrating a configuration of an ion source according to a sixth embodiment of the invention.

Subsequently, a sixth embodiment of the invention will be described with reference to FIG. 6. FIG. 6 illustrates a configuration of an ion source according to the embodiment. Further, the reference numerals refer to the same elements as in FIG. 1 and a detailed description thereof will be omitted. Herein, elements different from those of FIG. 1 will be primarily described. In addition, in FIG. 6, an aperture 18 also serves as an end portion of a transportation pipe 17.

In the embodiment, a vacuum chamber (second vacuum chamber) 36, which is a separate chamber from a vacuum chamber (first vacuum chamber) 10, is attached to the vacuum chamber 10, as illustrated in FIG. 6. A target (second target) 13, which is exchanged with a target (first target) 13 set in the vacuum chamber 10, is received in the vacuum chamber 36.

A vacuum pump 37, which may perform vacuum exhaustion independently from the vacuum chamber 10, is connected to the vacuum chamber 36. Further, a valve (first valve) 38, which opens/closes a flow channel, is provided between the vacuum chamber 10 and the vacuum chamber 36. The valve 38 is opened/closed to separate vacuum-conditions of the vacuum chamber 10 and the vacuum chamber 36.

Further, a guide 39 for transporting the target 13 from the vacuum chamber 36 to the vacuum chamber 10 is provided between a position in the vacuum chamber 36 where the target 13 is stored and a position in the vacuum chamber 10 where the target 13 is set.

In addition, the vacuum chamber 36 may be attached on the top or the bottom of the vacuum chamber 10 or attached to a left side or a right side of the vacuum chamber 10.

Further, since a laser beam is irradiated, a target holder 40 holding the target 13 set in the vacuum chamber 10 is provided in the vacuum chamber 10. An actuator 41, which removes the target 13 of which all surfaces are irradiated with the laser beam from the target holder 40, is provided in the target holder 40. In addition, the stepping motor 15 is connected to the target holder 40 and the target 13 held by the target holder 40 may be biaxially driven by the stepping motor 15.

Subsequently, an operation when the target 13 is exchanged in the ion source according to the embodiment will be described. Hereinafter, for example, the target 13 of which all the surfaces are irradiated with the laser beam, which is held by the target holder 40, is called a use completed target 13 and the target 13, which is exchanged with the use completed target, is called a preliminary target 13. Herein, the use completed target 13 is held by the target holder 40 in the vacuum chamber 10 and the preliminary target 13 is already stored in the vacuum chamber 36.

When the use completed target 13 is exchanged with the preliminary target 13, the vacuum chamber 36 is vacuum-exhausted by the vacuum pump 37 with a valve 38 closed, and the vacuum chamber 36 becomes in a vacuum state at the same level as the vacuum chamber 10, and thereafter, the valve 38 is opened.

Thereafter, the preliminary target 13 stored in the vacuum chamber 36 is transported from the vacuum chamber 36 to the vacuum chamber 10 by using, for example, a linear introducer or an actuator (not illustrated). In this case, the preliminary target 13 is transported along the guide 39 to be stably transported. Further, the guide 39 is divided at the position of the valve 38 so as to prevent the opening/closing of the valve 38 from interfering. The preliminary target 13 is transported from the vacuum chamber 36 to the vacuum chamber 10 and thereafter, the valve 38 is closed.

Meanwhile, the use completed target 13 held by the target holder 40 in the vacuum chamber 10 is removed from (the target holder 40 of) the vacuum chamber 10 before the preliminary target 13 is transported to the vacuum chamber 10. In detail, the bottom of the target holder 40 is opened by using an actuator 41, which linearly moves, to drop the use completed target 13 downward. As a result, the use completed target 13 is removed from the target holder 40 of the vacuum chamber 10.

By exchanging the use completed target 13 with the preliminary target 13, the laser beam is focused and irradiated onto the preliminary target 13 set in the vacuum chamber 10 to generate ions and the ions may be transported to an RFQ 50.

In the embodiment as described above, by a configuration in which the vacuum chamber 36 is vacuum-exhausted with the valve 38 closed and thereafter, the use completed target 13 set in the vacuum chamber 10 is exchanged with the preliminary target 13 stored in the vacuum chamber 36 with the valve 38 opened, the target 13 may be exchanged without releasing the vacuums of the vacuum chamber 10 and a downstream apparatus.

Seventh Embodiment

Figure 7:
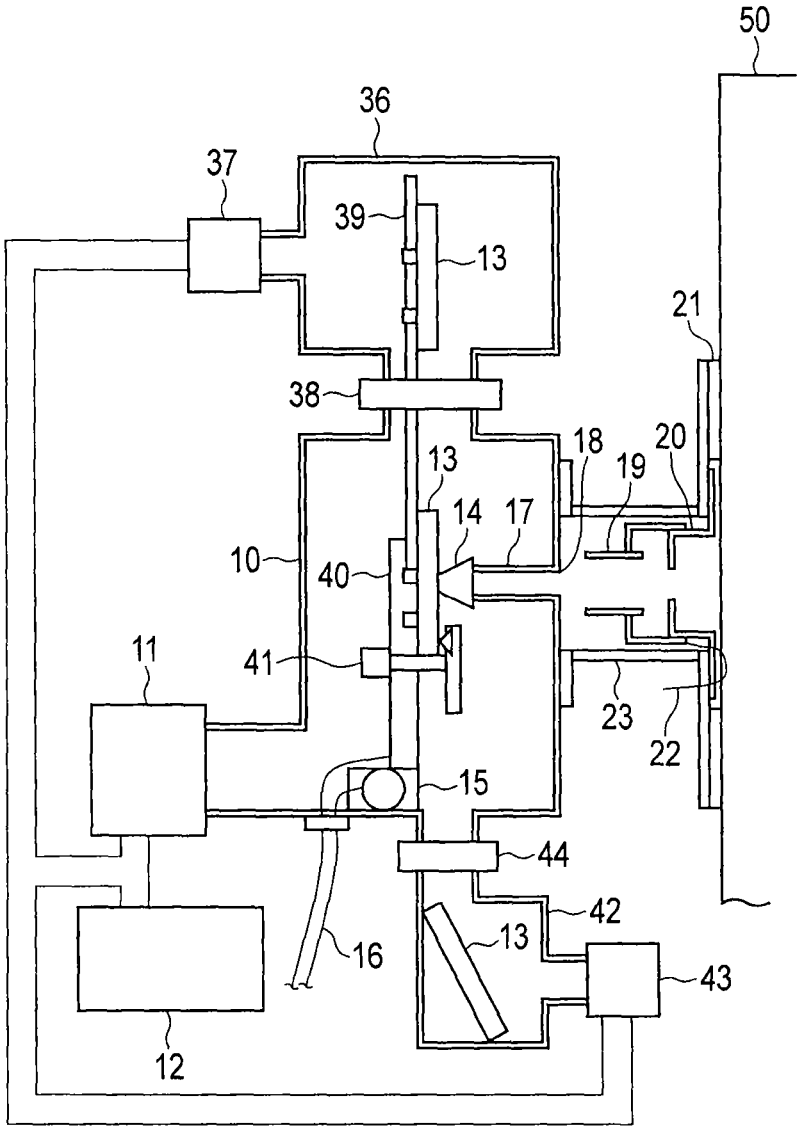
FIG. 7 is a cross-sectional view illustrating a configuration of an ion source according to a seventh embodiment of the invention.

Subsequently, a seventh embodiment of the invention will be described with reference to FIG. 7. FIG. 7 illustrates a configuration of an ion source according to the embodiment. Further, the reference numerals refer to the same elements as in FIG. 6 and a detailed description thereof will be omitted. Herein, elements different from those of FIG. 6 will be primarily described.

In the embodiment, a vacuum chamber (third vacuum chamber) 42, which is different from a vacuum chamber (second vacuum chamber) 36, is attached to the bottom of a vacuum chamber (first vacuum chamber) 10, as illustrated in FIG. 7. A use completed target 13, which is removed from a target holder 40 in the vacuum chamber 10 at the time of exchanging the target 13, is stored in the vacuum chamber 42. Further, in the embodiment, the vacuum chamber 36 is attached to the top of the vacuum chamber 10.

A vacuum pump 43, which may perform vacuum exhaustion independently from the vacuum chamber 10 and the vacuum chamber 36, is connected to the vacuum chamber 42. Further, a valve (second valve) 44, which opens/closes a flow channel, is provided between the vacuum chamber 10 and the vacuum chamber 42. The valve 44 is opened/closed to separate vacuum-conditions of the vacuum chamber 10 and the vacuum chamber 42.

Subsequently, an operation when the target 13 is exchanged in the ion source according to the embodiment will be described. In this case, the vacuum chamber 42 is vacuum-exhausted by the vacuum pump 43 and the valve 44 is in an opening state.

As described in the sixth embodiment, when the use completed target 13 held by the target holder 40 in the vacuum chamber 10 is exchanged, the use completed target 13 needs to be removed from the target holder 40, but the use completed target 13 is dropped to the bottom of the vacuum chamber 10 as the bottom of the target holder 40 is opened by using, for example, an actuator 41.

In this case, since the valve 44 provided between the vacuum chamber 42 attached to the bottom of the vacuum chamber 10 and the vacuum chamber 10 is in the opening state, the use completed target 13, which is dropped to the bottom of the vacuum chamber 10, is received (stored) in the vacuum chamber 42.

In the case where the use completed target 13 is received in the vacuum chamber 42, the valve 44 is in a closed state and the vacuum chamber 42 is released to the atmosphere to extract the use completed target 13 received in the vacuum chamber 42 without releasing vacuums of the vacuum chamber 10 and a downstream apparatus such as an RFQ 50.

Further, after the use completed target 13 removed from the target holder 40 in the vacuum chamber 10 is received in the vacuum chamber 42, a preliminary target 13 is transported and set in (the target holder 40 of) the vacuum chamber 10, but since an operation in which the preliminary target 13 is transported into the vacuum chamber 10 is the same as that described in the sixth embodiment, a detailed description thereof will be omitted.

In the embodiment as described above, by a configuration in which the vacuum chamber 42 is vacuum-exhausted with the valve 44 closed and thereafter, the use completed target 13 removed from the vacuum chamber 10 is stored in the vacuum chamber 42 with the valve 44 opened and the use completed target 13 is stored in the vacuum chamber 42 and thereafter, the preliminary target 13 is transported and set in the vacuum chamber 10, the target 13 may be exchanged without interfering with releasing the vacuum of the downstream apparatus.

Eighth Embodiment

Figure 8:
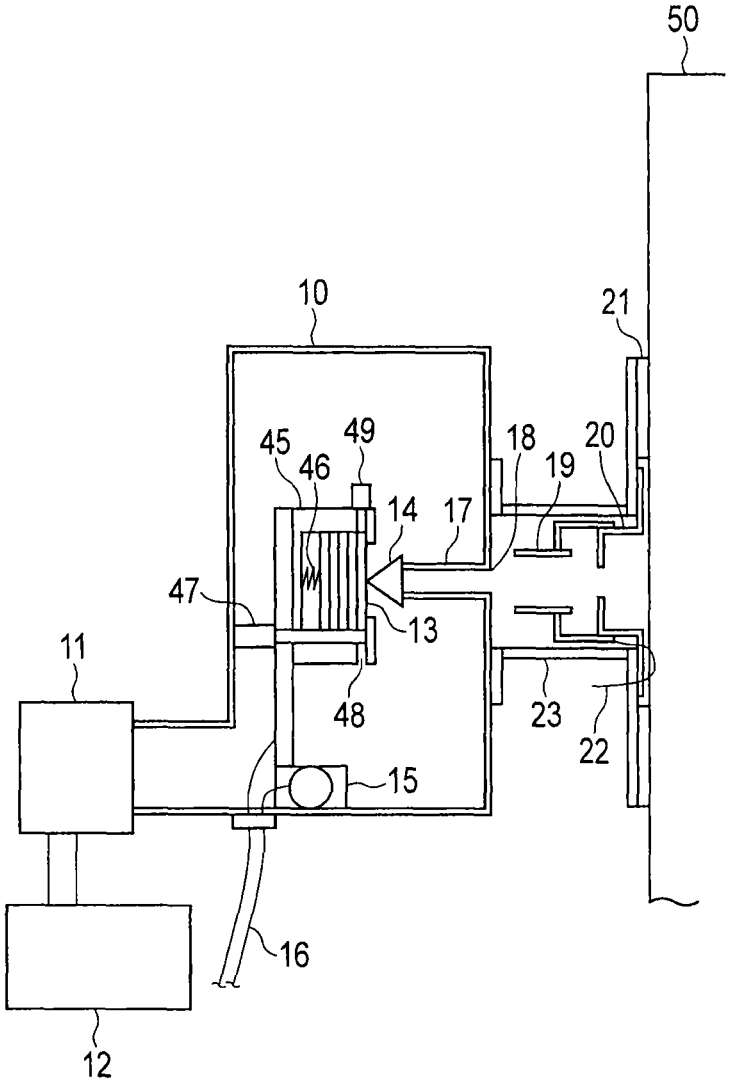
FIG. 8 is a cross-sectional view illustrating a configuration of an ion source according to an eighth embodiment of the invention.

Subsequently, an eighth embodiment of the invention will be described with reference to FIG. 8. FIG. 8 illustrates a configuration of an ion source according to the embodiment. Further, the reference numerals refer to the same elements as in FIG. 1 and a detailed description thereof will be omitted. Herein, elements different from those of FIG. 1 will be primarily described. In addition, in FIG. 8, an aperture 18 also serves as an end portion of a transportation pipe 17.

In the embodiment, a plurality of targets 13 is stacked and set in a vacuum chamber 10, as illustrated in FIG. 8.

A target holder 45 is provided in the vacuum chamber 10. The target holder 45 holds the targets 13 which are stacked. The targets 13 are brought in close contact and fixed in a direction (to a front surface of the target holder 45) to generate ions in the ion source by an elastic body (for example, a spring, and the like) 46 provided between the target 13 and the target holder 45, as illustrated in FIG. 8. Further, in the ion source according to the embodiment, a laser beam is irradiated to the target 13 set at an irradiation side (that is, a position to which the laser beam is irradiated) of the laser beam among the targets 13, and as a result, a plasma 14 is generated. Hereinafter, the target 13 set at the irradiation side of the laser beam among the targets 13 is called an irradiation target 13.

Further, the target holder 45 is connected with an actuator 47 and a hole portion 48 provided on the bottom of the irradiation target 13 may be opened by the actuator 47.

In addition, the target holder 45 is connected with an actuator 49 provided on the top (a set position) of the irradiation target 13 among the targets 13 held by the target holder 45. The irradiation target 13 may be extruded downward by the actuator 49.

Further, the actuators 47 and 49 connected to the target holder 45 are controllable from the outside of the vacuum chamber 10 via a cable (not illustrated).

Subsequently, an operation when the target 13 is exchanged in the ion source according to the embodiment will be described.

In the case where the laser beam is focused and irradiated onto all the surfaces of the irradiation target 13 among the targets 13 held by the target holder 45, the hole portion 48 provided on the bottom of the target holder 45 is opened by using the actuator 47 connected to the target holder 45. In this case, since the targets 13 held by the target holder 45 are brought in close contact and fixed in the generation direction of the ions by the elastic body 46, the irradiation target 13 is not dropped downward even in the case where the hole portion 48 is opened.

Herein, the irradiation target 13 is extruded downward by using the actuator (the actuator provided on the top of the irradiation target 13) 49 connected to the target holder 45. As a result, the irradiation target 13 may be dropped downward through the hole portion 48 opened by the actuator 47 as described above.

In the case where the irradiation target 13 is dropped downward through the hole portion 48, a target (a target set at an irradiation side of the laser beam next to the irradiation target 13) at a subsequent stage of the irradiation target 13 is extruded onto a frontmost surface of the target holder 45 by the elastic body 46. As a result, the irradiation target 13 is exchanged. Thereafter, the laser beam is irradiated to the exchanged target (that is, the target extruded onto the frontmost surface) 13.

That is, in the embodiment, the irradiation target 13 of which all the surfaces are irradiated with the laser beam, among the targets 13 stacked and held by the target holder 45 is removed from the target holder 45 and the target 13 at the subsequent stage of the irradiation target 13 is extruded to the front surface of the target holder 45 to exchange the target 13 without releasing the vacuum of the vacuum chamber 10 and the downstream apparatus until all the targets 13 held by the target holder 45 have been used.

Further, in the case where all the targets 13 held by the target holder 45 are used, the targets 13 may be newly held by the target holder 45 without releasing the vacuum of the vacuum chamber 10 and the downstream apparatus (for example, the RFQ 50) by using the vacuum chamber (the vacuum chamber 36 illustrated in FIG. 6) described in the sixth embodiment.

In addition, as described above, the target 13 dropped through the hole portion 48 may be stored in the vacuum chamber (the vacuum chamber 42 illustrated in FIG. 7) described in the seventh embodiment.

As described above, in the embodiment, by a configuration in which a target 13, which is set to be closest to the irradiation side of the laser beam, among the targets (the targets held by the target holder 45) 13 stacked and set in the vacuum chamber 10, is removed to exchange the target 13 to which the laser beam is irradiated, the target 13 may be exchanged without supplying the target 13 by releasing the vacuum of the vacuum chamber 10 and the downstream apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ion source connected through an insulation duct with a downstream-located linear accelerator which is located downstream of the ion source apparatus and which is vacuum exhausted, the ion source comprising:

a vacuum chamber which is vacuum-exhausted;

a target which is set in the vacuum chamber and which generates plasmas containing multi-charged ions by irradiation of a laser beam;

a transportation unit which transports the multi-charged ions contained in the plasmas generated by the target to the downstream-located linear accelerator via a transportation pipe, the insulation duct, an intermediate electrode, and an acceleration electrode; and a vacuum sealing unit which is located between the target and the insulation duct, and is located upstream of the intermediate electrode and the acceleration electrode, and is located upstream of the insulation duct, intermediate electrode, and acceleration electrode so as to separate vacuum-conditions of the vacuum chamber side and the downstream-located linear accelerator side, and is located at a position where the multi-charged ions contained in the plasmas in the vacuum chamber are transportable, and which seals one of ends of the transportation pipe before exchanging the target set in the vacuum chamber.

2. The ion source according to claim 1, wherein the vacuum sealing unit drives a vacuum sealing plate connected to an actuator by using the actuator to set the vacuum sealing plate at a position to seal the transportation unit.

3. The ion source according to claim 1, wherein the vacuum sealing unit linearly drives a vacuum sealing plate connected to a linear introducer by using the linear introducer to set the vacuum sealing plate at a position to seal the transportation unit.

4. The ion source according to claim 1, wherein the vacuum sealing unit rotates a vacuum sealing plate connected to a rotary introducer by using the rotary introducer to set the vacuum sealing plate at a position to seal the transportation unit.

5. The ion source according to claim 1, wherein the vacuum sealing unit closes a valve that opens/closes a flow channel in the transportation unit.

6. An ion source connected with a downstream-located apparatus which is located downstream of the ion source apparatus and which is vacuum exhausted, the ion source comprising:

a first vacuum chamber which is vacuum-exhausted;

a first target which is held by a target holder in the first vacuum chamber to be ablated and ionized by irradiation of a laser beam to generate plasmas;

a transportation unit which includes a transportation pipe, an insulation duct, and which transports ions contained in the plasmas generated by the first target via an intermediate electrode and an acceleration electrode, as the plasmas are, to a linear accelerator of the downstream-located apparatus, and accelerates the ions while extracting to make an ion beam;

a second vacuum chamber which is attached to the first vacuum chamber and is vacuum-exhausted independently from the first vacuum chamber;

a second target which is different from the first target stored in the second vacuum chamber; and a first valve which is located between the first target and the insulation duct and which opens/closes a flow channel between the first vacuum chamber and the second vacuum chamber, wherein the target holder is configured to drop the first target as a use completed target downward when a bottom of the target holder is opened by using an actuator which is linearly movable, and wherein the first target is exchanged with the second target stored in the second vacuum chamber with the first valve opened after the second vacuum chamber is vacuum-exhausted with the first valve closed.

7. The ion source according to claim 6, further comprising:

a third vacuum chamber which is attached to the first vacuum chamber and is different from the second vacuum chamber, which is vacuum-exhausted independently from the first vacuum chamber; and a second valve which opens/closes a flow channel between the first vacuum chamber and the third vacuum chamber, wherein the first target is stored in the third vacuum chamber from the first vacuum chamber with the second valve opened after the third vacuum chamber is vacuum-exhausted with the second valve closed and the second target is set in the first vacuum chamber after the first target is stored in the third vacuum chamber to exchange the first target with the second target.

* * * * *